US010173260B2

(12) United States Patent
Woodberry et al.

(10) Patent No.: US 10,173,260 B2
(45) Date of Patent: Jan. 8, 2019

(54) METHOD OF OPERATION OF TWIN ROLL STRIP CASTER TO REDUCE CHATTER

(71) Applicant: NUCOR CORPORATION, Charlotte, NC (US)

(72) Inventors: Peter Andrew Woodberry, Austinmer (AU); Nikolco Nikolovski, Figtree (AU); Wai Yee Daniel Yuen, Wollongong (AU)

(73) Assignee: NUCOR CORPORATION, Charlotte, NC (US)

( * ) Notice: Subject to any disclaimer, the term of this patent is extended or adjusted under 35 U.S.C. 154(b) by 0 days.

(21) Appl. No.: 15/491,335

(22) Filed: Apr. 19, 2017

(65) Prior Publication Data

US 2017/0297094 A1 Oct. 19, 2017

Related U.S. Application Data

(60) Provisional application No. 62/324,570, filed on Apr. 19, 2016.

(51) Int. Cl.
*B22D 11/16* (2006.01)
*B22D 11/06* (2006.01)

(52) U.S. Cl.
CPC ..... *B22D 11/166* (2013.01); *B22D 11/0622* (2013.01)

(58) Field of Classification Search
CPC ..... B22D 11/06; B22D 11/0622; B22D 11/16; B22D 11/166
(Continued)

(56) References Cited

U.S. PATENT DOCUMENTS 5,704,414 A * 1/1998 Breviere ..... B22D 11/066 164/428
8,141,615 B1 3/2012 Ferrando et al.
(Continued)

FOREIGN PATENT DOCUMENTS

GB 2216169 A 10/1989
WO 2008017102 A1 2/2008
WO 2013075096 A1 5/2013

OTHER PUBLICATIONS

International-type Search for Australian Provisional Application No. 2017900480 dated Apr. 11, 2017, 13 pages.
(Continued)

*Primary Examiner* — Kevin P Kerns
(74) *Attorney, Agent, or Firm* — Hahn Loeser & Parks LLP

(57) ABSTRACT

A method and apparatus for casting thin strip including assembling a pair of counter-rotating casting rolls forming a gap between the casting surfaces of the rolls at a nip between the rolls through which metal strip can be cast; assembling side dams adjacent end portions of the rolls to permit a casting pool of molten metal to be formed on the casting surfaces; counter-rotating the rolls such that the casting surfaces each travel inwardly toward the nip to form metal shells on the surfaces of the rolls and deliver a cast strip downwardly from the gap between the rolls with a mushy internal portion; and providing a drive mechanism to oscillate the gap amplitude between the casting rolls between ±5 and ±50 microns at a frequency between 1 and 7 hertz to vary thickness of the mushy internal portion in the cast strip and reduce chatter during casting.

19 Claims, 5 Drawing Sheets

(58) Field of Classification Search
USPC ..... 164/428, 480, 416, 478, 452
See application file for complete search history.

(56) References Cited

U.S. PATENT DOCUMENTS

| | | | |
|---|---|---|---|
| 8,322,402 | B2 | 12/2012 | Blejde et al. |
| 8,893,768 | B2 | 11/2014 | Nooning et al. |
| 8,960,265 | B2 | 2/2015 | Mahapatra et al. |
| 2006/0243417 | A1 | 11/2006 | Nikolovski et al. |
| 2011/0067835 | A1 | 3/2011 | Blejde et al. |
| 2012/0235314 | A1 | 9/2012 | Kweon et al. |
| 2014/0261905 | A1 | 9/2014 | Blejde et al. |
| 2015/0174651 | A1 | 6/2015 | Lee et al. |
| 2016/0332219 | A1 | 11/2016 | Shu et al. |

OTHER PUBLICATIONS

PCT/AU2017/050352 International Search Report dated Jul. 10, 2017, 6 pages.

* cited by examiner

METHOD OF OPERATION OF TWIN ROLL STRIP CASTER TO REDUCE CHATTER

This application claims priority to, and the benefit of, U.S. Provisional Application No. 62/324,570 filed on Apr. 19, 2016 with the United States Patent Office, which is hereby incorporated by reference.

BACKGROUND AND SUMMARY

This invention relates to making thin strip and more particularly casting of thin strip by a twin roll caster.

In a twin roll caster, molten metal is introduced between a pair of counter-rotated horizontal casting rolls that are internally water cooled so that metal shells form on the moving casting roll surfaces. The metal shells are brought together at a nip between them to produce a solidified strip product delivered downwardly from the nip between the casting rolls. The term "nip" is used herein to refer to the general region at which the casting rolls are closest together. The molten metal may be poured from a ladle into a smaller vessel or series of smaller vessels from which it flows through a metal delivery nozzle or nozzles located above the nip, to form a casting pool of molten metal supported on the casting surfaces of the casting rolls above the nip and extending the length of the nip. The casting pool is usually confined between side plates or dams held in sliding engagement with end surfaces of the casting rolls to restrict the casting pool against outflow. The upper surface of the casting pool (generally referred to as the "meniscus" level) is usually above the lower end of the delivery nozzle so that the lower end of the delivery nozzle is immersed within the casting pool.

During casting, the casting rolls rotate such that the metal from the casting pool solidifies into metal shells on the casting rolls that are brought together at the nip to produce a cast strip downwardly from the nip. One of the difficulties in the past during the casting operation has been chatter. Chatter is a phenomenon where the casting machine vibrates typically around one of two main frequencies, generally about 35 hertz (Hz) and 65 hertz (Hz).

It has been proposed that chatter is generated when the metal shells solidified on the moving surfaces of the casting rolls are brought together at the nip and rub and interact against each other. The metal shells have many small raised areas. A wide spectrum of frequencies is generated when these small raised areas rub and interact with each other. These excite the natural frequencies of the casting machine system during the casting operation and the casting machine vibrates at these natural frequencies creating chatter.

In addition, vibration of the casting rolls at the natural frequencies also causes disturbances at the meniscus. These disturbances cause variation in the solidification process, which in turn, when they reach the nip, reinforces the vibration of the casting rolls. Hence, the chatter is further amplified and modulated by this regenerative mechanism.

Chatter should be avoided because of the surface defects and thickness variation chatter causes in the cast strip. When chatter becomes severe, horizontal lines may be observed across the width of the cast strip. If chatter is extreme, breakage of the strip may occur.

It has been previously suggested to reduce chatter by lowering the casting roll separation force and allowing "mushy" material (i.e. liquid metal between the metal shells) to be "swallowed" between the metal shells during casting. However, the problem with this approach was that if the casting roll force is lowered too much so the gap between the casting rolls is too large, the mushy material between the metal shells will cause defects in the strip such as ridges. To further explain, immediately below the nip, the mushy material in the strip is in communication with the casting pool due to the ferrostatic pressure. The mushy material releases energy to the cast strip just after exiting the nip. As a result, the surface of the strip gets too hot and yields under the influence of the ferrostatic head from the casting pool, causing surfaces defects known as ridges in the cast strip. Therefore, there is still a need for an efficient method to reduce chatter during the casting operation.

We have found a method to reduce chatter by a controlled oscillation of the gap between the casting rolls allowing a controlled intermittent amount of mushy material between the metal shells providing dampening of the system and reducing chatter during a casting operation. The mushy material may include molten metal and partial solidified metal, and includes all the material between the metal shells not sufficiently solidified to be self-supporting.

It has also been found that chatter may be reduced by oscillating the casting speed. The casting speed may be oscillated at an amplitude between ±1 and ±4 m/min and at a frequency between 1 and 5 hertz. Further, the casting speed may be oscillated at an amplitude between ±2 and ±3 m/min and at a frequency between 2 and 4 hertz.

Currently disclosed is a method of casting thin strip comprising the steps of: assembling a pair of counter-rotating casting rolls laterally forming a gap between circumferential casting surfaces of the casting rolls at a nip between the casting rolls through which metal strip can be cast; assembling side dams adjacent end portions of the casting rolls to permit a casting pool of molten metal to be formed and supported by the casting surfaces of the casting rolls; assembling a metal delivery system above the casting rolls adapted to deliver molten metal to form the casting pool supported on the casting surfaces of the casting rolls above the gap and confined by the side dams; counter-rotating the casting rolls such that the casting surfaces of the casting rolls each travel inwardly toward the nip to form metal shells on the surfaces of the casting rolls and deliver a cast strip downwardly from the gap between the casting rolls with a mushy internal portion; and providing a drive mechanism to oscillate the gap between the casting rolls at an amplitude between ±5 and ±50 microns (or μm) at a frequency between 1 and 7 hertz (or Hz) to vary thickness of the mushy internal portion in the cast strip and reduce chatter during casting.

The oscillating of the gap between the casting rolls at the nip may be performed by sinusoid oscillation. Alternatively, the oscillating of the gap between the casting rolls at the nip may be provided by a periodic function, for example a step function, to change the gap between the casting rolls.

The gap between the casting rolls at the nip may be oscillated at an amplitude between ±10 and ±40 microns (or μm). Furthermore, the gap between the casting rolls at the nip may be oscillated at an amplitude between ±20 and ±30 microns (or μm). Additionally, the gap between the casting rolls at the nip may be oscillated between at a frequency between 2 and 5 hertz (or Hz).

Also disclosed is an apparatus for casting thin strip. The apparatus comprising at least a pair of counter-rotating casting rolls where each casting roll having a circumferential casting surface and a pair of end portions. A lateral gap is formed between the circumferential casting surfaces of each casting roll at a nip between the casting rolls through which a metal strip can be cast. At least a pair of side dams are adjacent the end portions of the casting rolls to permit a casting pool of molten metal to be formed supported by the casting surfaces of the casting rolls. A metal delivery system above the casting rolls is provided for delivering molten metal to form the casting pool supported by the casting surfaces of the casting rolls above the lateral gap and confined by the side dams. Finally, a drive mechanism is provided to oscillate the gap between the casting rolls at an amplitude between ±5 and ±50 μm at a frequency between 1 and 7 hertz to vary a thickness of a mushy material in the cast strip and reduce chatter during casting.

BRIEF DESCRIPTION OF THE DRAWINGS

In order that the invention may be described in more detail, some illustrative examples will be given with reference to the accompanying drawings in which.

DETAILED DESCRIPTION OF THE DRAWINGS

The following description of the embodiments is in the context of high strength thin cast strip with microalloy additions made by continuous casting steel strip using a twin roll caster.

Figure 1:
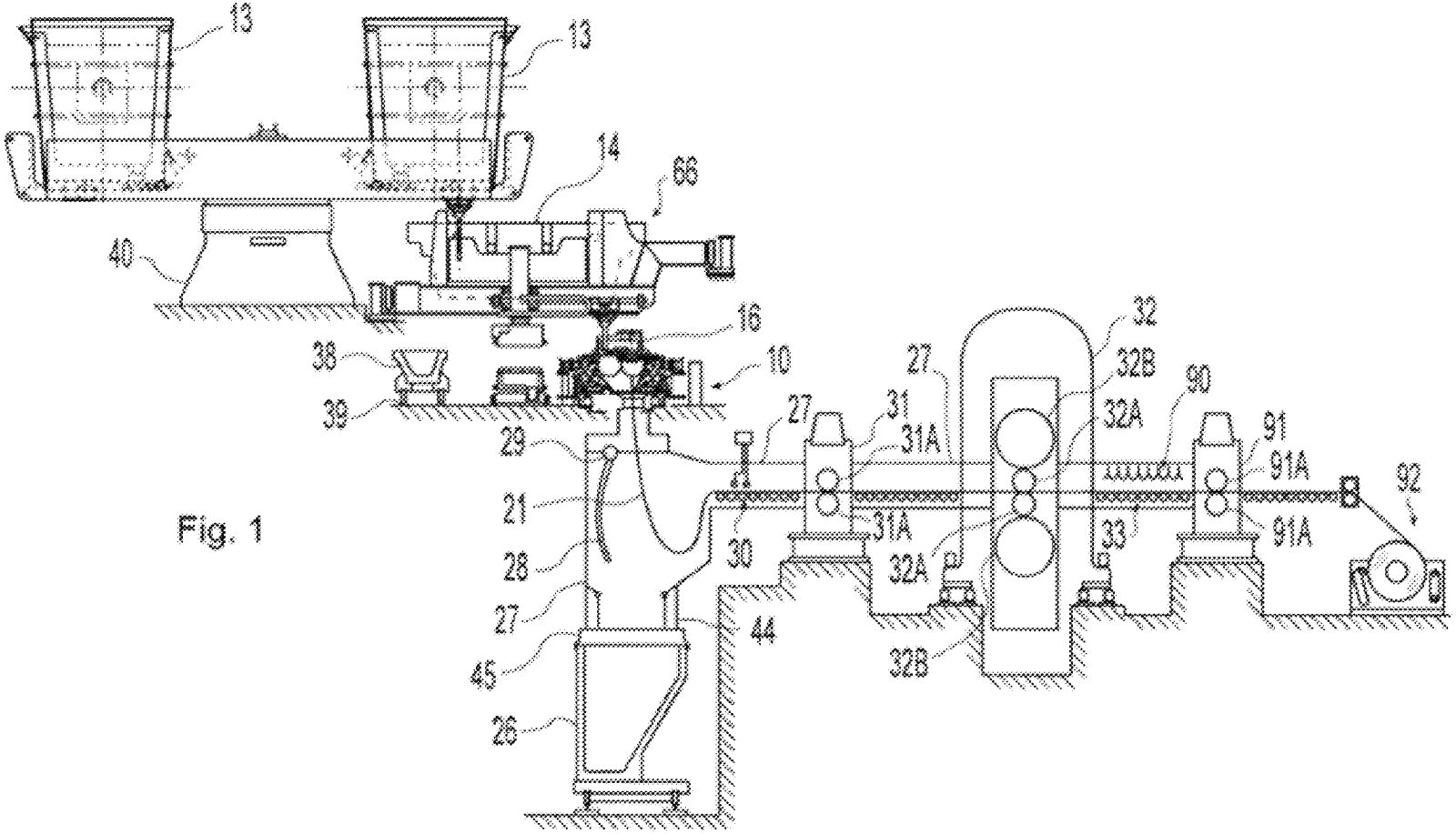
FIG. 1 is a diagrammatical side view of a twin roll caster of the present disclosure.
Figure 2:
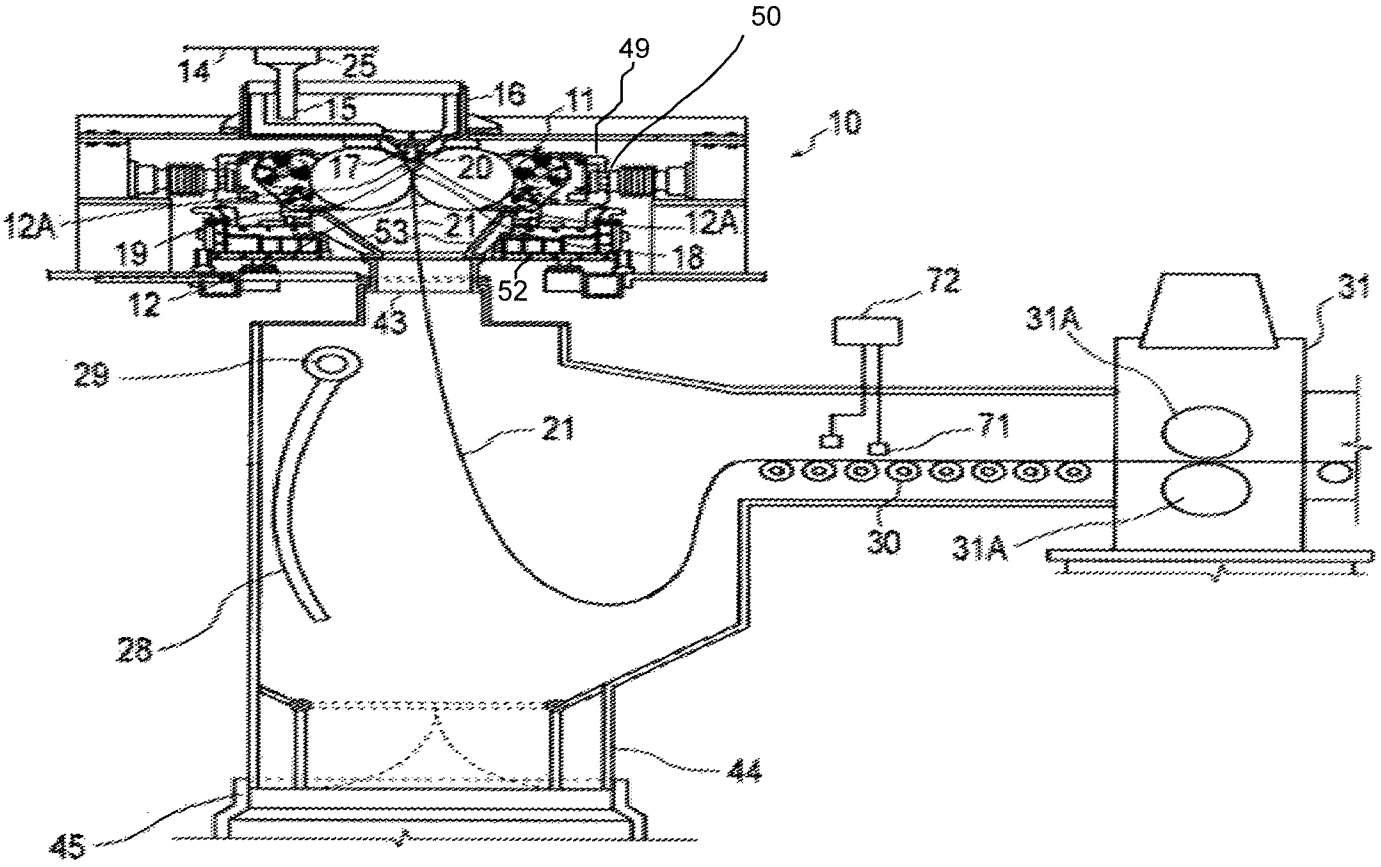
FIG. 2 is an enlarged partial sectional view of a portion of the twin roll caster of FIG. 1 including a strip inspection device for measuring strip profile.
Figure 2A:
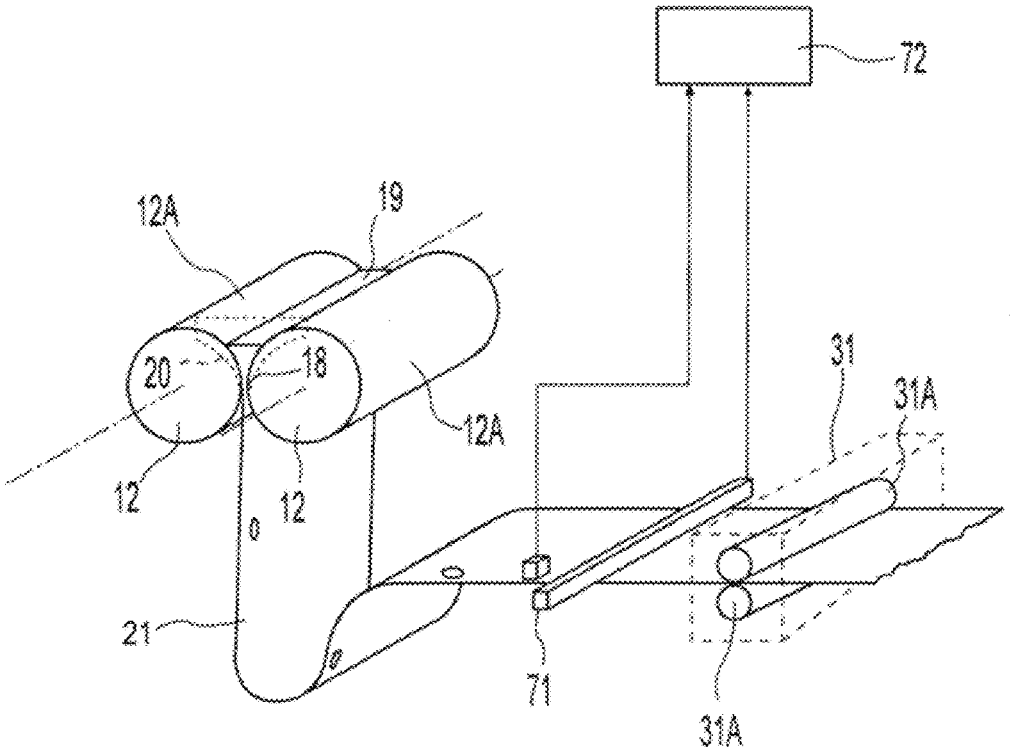
FIG. 2A is a schematic view of a portion of twin roll caster of FIG. 2.

Referring now to FIGS. 1, 2, and 2A, a twin roll caster is illustrated that comprises a main machine frame 10 that stands up from the factory floor and supports a pair of counter-rotatable casting rolls 12 mounted in a module in a roll cassette 11. The casting rolls 12 are mounted in the roll cassette 11 for ease of operation and movement as described below. The roll cassette 11 facilitates rapid movement of the casting rolls 12 ready for casting from a setup position into an operative casting position as a unit in the caster, and ready removal of the casting rolls 12 from the casting position when the casting rolls 12 are to be replaced. There is no particular configuration of the roll cassette 11 that is desired, so long as it performs that function of facilitating movement and positioning of the casting rolls 12 as described herein.

The casting apparatus for continuously casting thin steel strip includes the pair of counter-rotatable casting rolls 12 having casting surfaces 12A laterally positioned to form a nip 18 there between. Molten metal is supplied from a ladle 13 through a metal delivery system to a metal delivery nozzle 17 (core nozzle) positioned between the casting rolls 12 above the nip 18. Molten metal thus delivered forms a casting pool 19 of molten metal above the nip 18 supported on the casting surfaces 12A of the casting rolls 12. This casting pool 19 is confined in the casting area at the end portions of the casting rolls 12 by a pair of side closure plates, or side dams 20 (shown in dotted line in FIG. 2A). The upper surface of the casting pool 19 (generally referred to as the "meniscus" level) may rise above the lower end of the delivery nozzle 17 so that the lower end of the delivery nozzle 17 is immersed within the casting pool 19. The casting area includes the addition of a protective atmosphere above the casting pool 19 to inhibit oxidation of the molten metal in the casting area.

The ladle 13 typically is of a conventional construction supported on a rotating turret 40. For metal delivery, the ladle 13 is positioned over a movable tundish 14 in the casting position to fill the tundish 14 with molten metal. The movable tundish 14 may be positioned on a tundish car 66 capable of transferring the tundish 14 from a heating station (not shown), where the tundish 14 is heated to near a casting temperature, to the casting position. A tundish guide, such as rails 39, may be positioned beneath the tundish car 66 to enable moving the movable tundish 14 from the heating station to the casting position.

An overflow container 38 may be provided beneath the movable tundish 14 to receive molten material that may spill from the tundish 14. As shown in FIG. 1, the overflow container 38 may be movable on rails 39 or another guide such that the overflow container 38 may be placed beneath the movable tundish 14 as desired in casting locations. Additionally, an optional overflow container (not shown) may be provided for the distributor 16 adjacent the distributor 16.

The movable tundish 14 may be fitted with a slide gate 25, actuable by a servo mechanism, to allow molten metal to flow from the tundish 14 through the slide gate 25, and then through a refractory outlet shroud 15 to a transition piece or distributor 16 in the casting position. From the distributor 16, the molten metal flows to the delivery nozzle 17 positioned between the casting rolls 12 above the nip 18.

The side dams 20 may be made from a refractory material such as zirconia graphite, graphite alumina, boron nitride, boron nitride-zirconia, or other suitable composites. The side dams 20 have a face surface capable of physical contact with the end portions of the casting rolls 12 and molten metal in the casting pool 19. The side dams 20 are mounted in side dam holders (not shown), which are movable by side dam actuators (not shown), such as a hydraulic or pneumatic cylinder, servo mechanism, or other actuator to bring the side dams 20 into engagement with the end portions of the casting rolls 12. Additionally, the side dam actuators are capable of positioning the side dams 20 during casting. The side dams 20 form end closures for the molten pool of metal on the casting rolls 12 during the casting operation.

FIG. 1 shows the twin roll caster producing the cast strip 21, which passes across a guide table 30 to a pinch roll stand 31, comprising pinch rolls 31A. Upon exiting the pinch roll stand 31, the thin cast strip 21 may pass through a hot rolling mill 32, comprising a pair of work rolls 32A, and backup rolls 32B, forming a gap capable of hot rolling the cast strip 21 delivered from the casting rolls 12, where the cast strip 21 is hot rolled to reduce the strip to a desired thickness, improve the strip surface, and improve the strip flatness. The work rolls 32A have work surfaces relating to the desired strip profile across the work rolls 32A. The hot rolled cast strip 21 then passes onto a run-out table 33, where it may be cooled by contact with a coolant, such as water, supplied via nozzle jets 90 or other suitable means, and by convection and radiation. In any event, the hot rolled cast strip 21 may then pass through a second pinch roll stand 91 having rollers 91A to provide tension of the cast strip 21, and then to a coiler 92.

At the start of the casting operation, a short length of imperfect strip is typically produced as casting conditions stabilize. After continuous casting is established, the casting rolls 12 are moved apart slightly and then brought together again to cause this leading end of the cast strip 21 to break away forming a clean head end of the following cast strip 21. The imperfect material drops into a scrap receptacle 26, which is movable on a scrap receptacle guide. The scrap receptacle 26 is located in a scrap receiving position beneath the caster and forms part of a sealed enclosure 27 as described below. The enclosure 27 is typically water cooled. At this time, a water-cooled apron 28 that normally hangs downwardly from a pivot 29 to one side in the enclosure 27 is swung into position to guide the clean end of the cast strip 21 onto the guide table 30 that feeds it to the pinch roll stand 31. The apron 28 is then retracted back to its hanging position to allow the cast strip 21 to hang in a loop beneath the casting rolls 12 in enclosure 27 before it passes to the guide table 30 where it engages a succession of guide rollers.

The sealed enclosure 27 is formed by a number of separate wall sections that fit together at various seal connections to form a continuous enclosure wall that permits control of the atmosphere within the enclosure 27. Additionally, the scrap receptacle 26 may be capable of attaching with the enclosure 27 so that the enclosure 27 is capable of supporting a protective atmosphere immediately beneath the casting rolls 12 in the casting position. The enclosure 27 includes an opening in the lower portion of the enclosure 27, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal," "sealed," "sealing," and "sealingly" in reference to the scrap receptacle 26, enclosure 27, and related features may not be a complete seal so as to prevent leakage, but rather is usually less than a perfect seal as appropriate to allow control and support of the atmosphere within the enclosure 27 as desired with some tolerable leakage A rim portion 45 may surround the opening of the lower enclosure portion 44 and may be movably positioned above the scrap receptacle 26, capable of sealingly engaging and/or attaching to the scrap receptacle 26 in the scrap receiving position. The rim portion 45 may be movable between a sealing position in which the rim portion 45 engages the scrap receptacle 26, and a clearance position in which the rim portion 45 is disengaged from the scrap receptacle 26. Alternately, the caster or the scrap receptacle 26 may include a lifting mechanism to raise the scrap receptacle 26 into sealing engagement with the rim portion 45 of the enclosure 27, and then lower the scrap receptacle 26 into the clearance position. When sealed, the enclosure 27 and scrap receptacle 26 are filled with a desired gas, such as nitrogen, to reduce the amount of oxygen in the enclosure 27 and provide a protective atmosphere for the cast strip 21.

The enclosure 27 may include an upper collar portion 43 supporting a protective atmosphere immediately beneath the casting rolls 12 in the casting position. When the casting rolls 12 are in the casting position, the upper collar portion 43 is moved to the extended position closing the space between a housing portion 53 adjacent the casting rolls 12, as shown in FIG. 2, and the enclosure 27. The upper collar portion 43 may be provided within or adjacent the enclosure 27 and adjacent the casting rolls 12, and may be moved by a plurality of actuators (not shown) such as servo-mechanisms, hydraulic mechanisms, pneumatic mechanisms, and rotating actuators.

The casting rolls 12 are internally cooled, typically with water, as described below so that as the casting rolls 12 are counter-rotated, metal shells solidify on the casting surfaces 12A, as the casting surfaces 12A move into contact with and through the casting pool 19 with each revolution of the casting rolls 12. The metal shells are brought close together at the nip 18 between the casting rolls 12 to produce a thin cast strip product 21 delivered downwardly from the nip 18. The thin cast strip product 21 is formed from the metal shells at the nip 18 between the casting rolls 12 and delivered downwardly and moved downstream as described herein.

A strip thickness profile sensor 71 may be positioned downstream to detect the thickness profile of the cast strip 21 as shown in FIGS. 2 and 2A. The strip thickness sensor 71 may be provided between the nip 18 and the pinch rolls 31A to provide for direct control of the casting roll 12. The sensor may be an x-ray gauge or other suitable device capable of directly measuring the thickness profile across the width of the strip periodically or continuously. Alternatively, a plurality of non-contact type sensors may be arranged across the cast strip 21 at the roller table 30 and the combination of thickness measurements from the plurality of positions across the cast strip 21 are processed by a controller 72 to determine the thickness profile of the strip periodically or continuously. The thickness profile of the cast strip 21 may be monitored from this data periodically or continuously as desired.

Chatter was effectively reduced by controlling the oscillation of the gap between the casting rolls and allowing a controlled amount of mushy material between the metal shells of the cast strip. In some examples, the controlled amount of mushy material maintains a continuous amount of mushy material between the metal shells of the cast strip.

To control the oscillation of the gap between the casting rolls, one or both of the casting rolls may be moved back and forth in lateral movement by a drive mechanism. The lateral movement may be perpendicular to the cast strip. By example, a roll chock positioning system may be provided on the main machine frame 10 to enable movement of the casting rolls on a cassette frame of a roll cassette 11, the roll cassette 11 being illustrated in FIG. 2. A suitable roll chock positioning system is more fully described in U.S. Publication No. 2011/0067835 A1, which is herein incorporated by reference in its entirety. In particular, the roll cassette 11 comprises a cassette frame 52 and roll chocks 49 capable of supporting the casting rolls 12 and moving the casting rolls on the cassette frame. The cassette frame 52 may include linear bearings and/or other guides adapted to assist movement of the casting rolls toward and away from one another. Further, positioning assemblies 50 may be connected to the roll cassette 11 and enable movement of the casting rolls 12 on the cassette frame 52 as a drive mechanism. Other examples of moving the casting rolls may alternatively or additionally include thrust transmission structures connected to the respective roll support, and a reaction structure generating (exerting) a thrust on the roller support. A suitable thrust transmission structure is more fully described in International Publication WO 2008/017102 A1, which is herein incorporated by reference in its entirety. Other examples of drive mechanism for controlling the oscillation of the gap are also contemplated herein. The drive mechanism for controlling the oscillation of the gap between the casting rolls may be set to run in controlled loops to maintain tolerances. Additionally or alternatively, actuators may be provided to enable movement of the casting rolls during casting to adjust, maintain, and/or change tolerances. Such adjustments may occur in response to forces and/or conditions encountered during casting. The actuators may be further initiated by sensors which measure and report the position of the casting rolls for processing.

As used herein, oscillation is movement that varies in magnitude or position, i.e. amplitude, for example in a regular manner, about a centre-point. Gap oscillation is any cyclical movement of one or more rolls toward and away from each other in a lateral direction to the direction of movement of the strip to change the gap between the rolls. When multiple casting rolls move, the cyclical movement of each casting roll may be independent of the opposing casting roll or may be relative to the opposing casting roll. By example, each casting roll may move in unison, in opposition, or in disharmony relative the opposing casting roll. In other examples, only one casting roll may move and/or the movement of opposing casting rolls may alternate.

During casting, the casting rolls counter-rotate such that the casting surfaces of the casting rolls each travel inwardly toward the nip to form metal shells on the surfaces of the casting rolls. A cast strip is delivered downwardly from the gap between the casting rolls with a mushy internal portion. A drive mechanism oscillates the gap between the casting rolls at an amplitude between ±5 and ±50 microns (or μm) at a frequency between 1 and 7 hertz (or Hz) to vary thickness of the mushy internal portion in the cast strip and reduce chatter during casting. In one example, the amplitude and/or the frequency may be variable. By way of an example, an amplitude which oscillates at an amplitude of ±5 microns (or μm) provides a change in the gap that is 10 microns (or μm). In some examples, the amplitude and/or the frequency may be a variable, a constant, or a combination.

In some examples, the oscillating of the gap between the casting rolls at the nip may be performed by sinusoid oscillation. As used herein, sinusoid oscillation provides that a gap varies with time in a sinusoidal path about a centre-point with the amplitude being the maximum change in the gap in a direction away from the centre-point, where the centre-point is the central axis of a waveform. For example, a gap oscillates between the amplitude in a sinusoidal path with time under sinusoid oscillation. Alternatively, the oscillating of the gap between the casting rolls at the nip may be provided by a periodic function, for example a step function, to change the gap between the casting rolls.

In particular examples, the gap between the casting rolls at the nip may be oscillated at an amplitude between ±10 and ±40 microns (or μm). Furthermore, the gap between the casting rolls at the nip may be oscillated at an amplitude between ±20 and ±30 microns (or μm). Additionally, the gap between the casting rolls at the nip may be oscillated between at a frequency between 2 and 5 hertz (or Hz).

Figure 3:
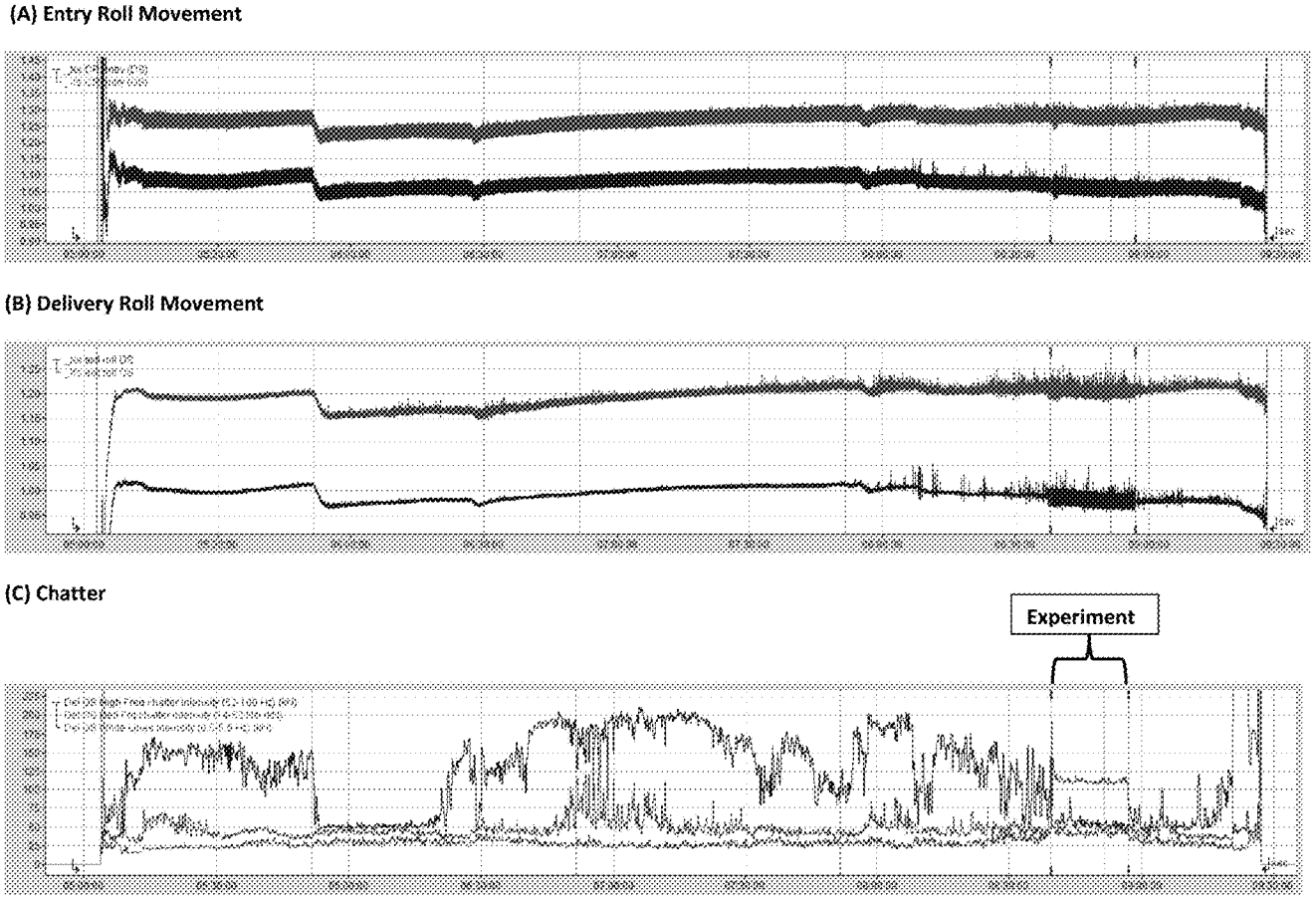
FIG. 3 is a graphical representation of chatter reduction.

FIG. 3 shows, for example, a gap oscillation frequency of 4 Hz with an oscillation amplitude of ±15 μm. Top graph (A) represents the entry roll movement. Center graph (B) represents the delivery roll movement (i.e. the casting roll closer to the coiler) and bottom graph (C) represents the chatter. As illustrated by graph B, the delivery roll was oscillated at ±15 μm at a frequency of 4 Hz. The gap oscillation on graph (B) is evident by the change in thickness in the lines from the gap oscillation, which started at approximately the 8:40 time mark. Chatter is represented by the top line in graph (C). The high frequency chatter intensity index reached values of over 200. As clearly illustrated in graph (C), chatter was effectively decreased by a controlled oscillation of the gap between the casting rolls, which allows a controlled intermittent amount of mushy material between the metal shells.

Figure 4:
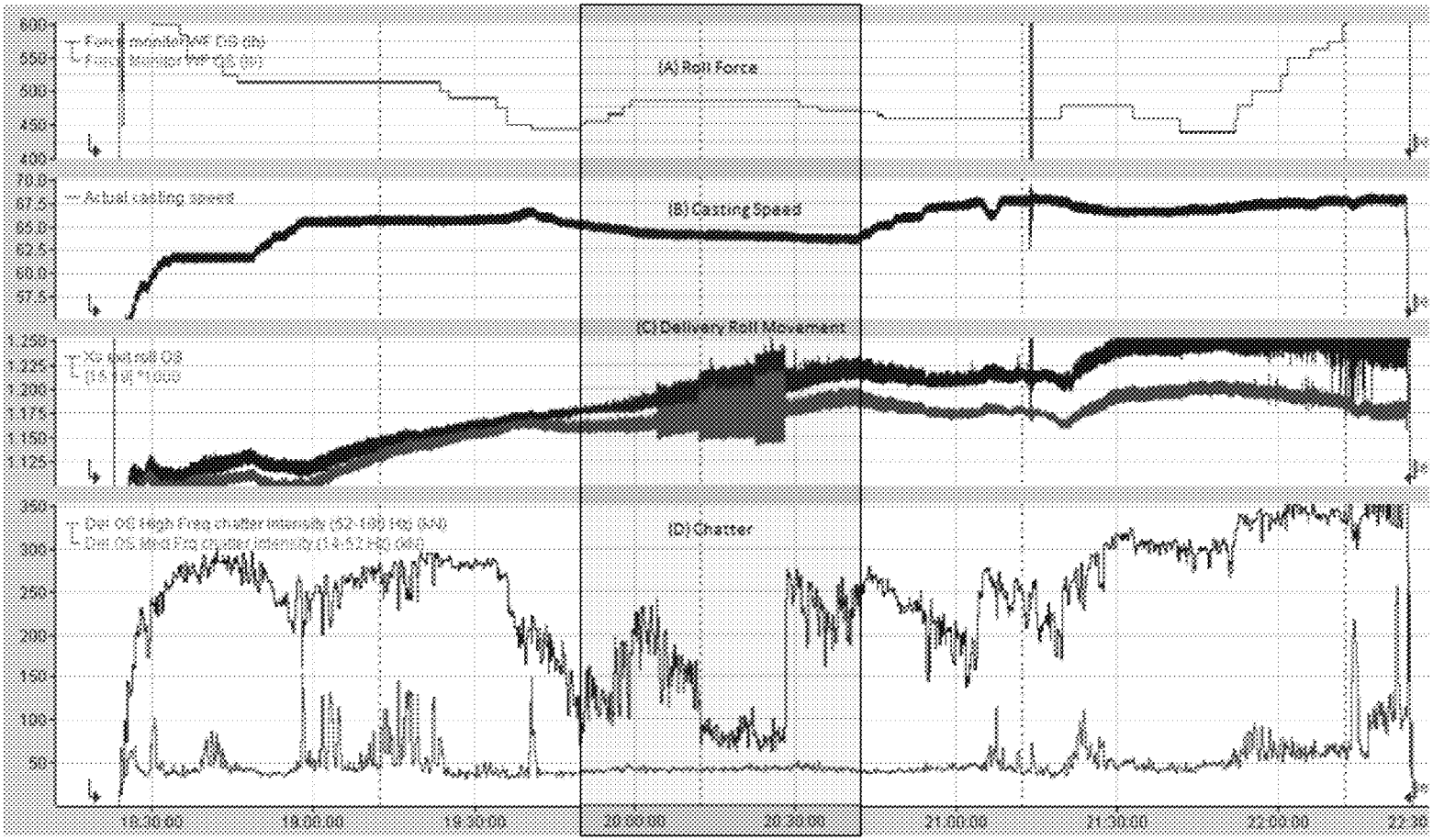
FIG. 4 is a graphical representation of chatter reduction.

Similarly, FIG. 4 illustrates gap oscillation amplitude of ±10, ±20, and ±30 μm at a frequency of 4 Hz. Top graph (A) represents the roll force. Second graph (B) represents the casting speed. Third graph (C) represents the delivery roll movement. Bottom graph (D) represents the chatter. The gap oscillation on graph (C) is evident by the change in thickness of the lines from the gap oscillation, which started at approximately the 20:20 time mark. As the delivery roll lines get wider and wider, corresponding to the gap oscillation, the chatter decreases significantly. As it can be seen, once the gap oscillation was stopped, the chatter increased immediately. Accordingly, it is clearly illustrated that gap oscillation effectively decreases high frequency chatter.

FIG. 4 also shows that a reduction in chatter was possible even while maintaining high forces on the casting rolls. As such, the possibility of surface defects such as ridges occurring in the cast strip decreases significantly.

While the principle and mode of operation of this invention have been explained and illustrated with regard to particular embodiments, it must be understood, however, that this invention may be practiced otherwise than as specifically explained and illustrated without departing from its spirit or scope.

What is claimed is:

1. A method of casting thin strip comprising the steps of:

assembling a pair of counter-rotating casting rolls laterally forming a gap between circumferential casting surfaces of the casting rolls at a nip between the casting rolls through which metal strip is cast;

assembling side dams adjacent end portions of the casting rolls to permit a casting pool of molten metal to be formed and supported by the casting surfaces of the casting rolls;

assembling a metal delivery system above the casting rolls adapted to deliver molten metal to form the casting pool supported on the casting surfaces of the casting rolls above the gap and confined by the side dams;

counter-rotating the casting rolls such that the casting surfaces of the casting rolls each travel inwardly toward the nip to form metal shells on the surfaces of the casting rolls and deliver a cast strip downwardly from the gap between the casting rolls with a mushy internal portion; and providing a drive mechanism to directly move one or more casting rolls of the pair of casting rolls to oscillate the gap between the casting rolls at an amplitude between ±5 and ±50 μm at a frequency between 1 and 7 hertz to vary thickness of the mushy internal portion in the cast strip and reduce chatter during casting.

2. The method of casting thin strip as claimed in claim 1 where the oscillating of the gap between the casting rolls at the nip is performed by sinusoid oscillation.

3. The method of casting thin strip as claimed in claim 1 where the oscillating of the gap between the casting rolls at the nip is provided by a periodic function to change the gap between the casting rolls.

4. The method of casting thin strip as claimed in claim 1 where the oscillating of the gap between the casting rolls at the nip is at an amplitude between +10 and +40 μm.

5. The method of casting thin strip as claimed in claim 1 where the oscillating of the gap between the casting rolls at the nip is at an amplitude between +20 and +30 μm.

6. The method of casting thin strip as claimed in claim 1 where the oscillating of the gap between the casting rolls at the nip is oscillated at a frequency between 2 and 5 hertz.

7. The method of casting thin strip as claimed in claim 1 where the amplitude is constant.

8. The method of casting thin strip as claimed in claim 1 where the frequency is constant.

9. The method of casting thin strip as claimed in claim 1 where the amplitude and the frequency are constant.

10. The method of casting thin strip as claimed in claim 1 where the drive mechanism moves one casting roll of the pair of casting rolls.

11. The method of casting thin strip as claimed in claim 1 where the drive mechanism moves the pair of casting rolls.

12. The method of casting thin strip as claimed in claim 11 where the pair of casting rolls move in unison.

13. The method of casting thin strip as claimed in claim 11 where the pair of casting rolls move in opposition.

14. The method of casting thin strip as claimed in claim 11 where the pair of casting rolls move in disharmony.

15. The method of casting thin strip as claimed in claim 1 where the drive mechanism comprises a roll support and an actuator where the actuator enables movement of the one or more casting rolls on the roll support.

16. The method of casting thin strip as claimed in claim 15 where the roll support comprises a cassette frame and one or more roll chocks for supporting the one or more casting rolls and where the one or more casting rolls move on the cassette frame.

17. An apparatus for casting thin strip comprising:

at least a pair of counter-rotating casting rolls, each casting roll having a circumferential casting surface and a pair of end portions, where a lateral gap is formed between the circumferential casting surfaces of each casting roll at a nip between the casting rolls through which a metal strip is cast;

at least a pair of side dams adjacent the end portions of the casting rolls to permit a casting pool of molten metal to be formed and supported by the casting surfaces of the casting rolls;

a metal delivery system above the casting rolls for delivering molten metal to form the casting pool supported by the casting surfaces of the casting rolls above the lateral gap and confined by the side dams; and a drive mechanism configured to directly move one or more casting rolls of the pair of casting rolls to oscillate the gap between the casting rolls at an amplitude between ±5 and ±50 μm at a frequency between 1 and 7 hertz to vary a thickness of a mushy material in the cast strip and reduce chatter during casting.

18. The apparatus for casting thin strip as claimed in claim 17 where the drive mechanism comprises a roll support and an actuator where the actuator is for enabling movement of the one or more casting rolls on the roll support.

19. The apparatus for casting thin strip as claimed in claim 18 where the roll support comprises a cassette frame and one or more roll chocks for supporting the one or more casting rolls and where the one or more casting rolls move on the cassette frame.

* * * * *